US006446456B2

(12) United States Patent
Ryu

(10) Patent No.: US 6,446,456 B2
(45) Date of Patent: Sep. 10, 2002

(54) HEAT PUMP AND METHOD FOR CONTROLLING OPERATION THEREOF

(75) Inventor: Yun Ho Ryu, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/768,627

(22) Filed: Jan. 25, 2001

(30) Foreign Application Priority Data

Apr. 18, 2000 (KR) ..... 00-20433

(51) Int. Cl.[7] ..... F25B 13/00
(52) U.S. Cl. ..... 62/324.6; 62/324.1; 137/455
(58) Field of Search ..... 62/324.1; 137/455

(56) References Cited

U.S. PATENT DOCUMENTS 3,985,154 A * 10/1976 Hargraves ..... 137/625.29
4,340,202 A * 7/1982 Hargraves et al. ..... 251/31
5,680,898 A * 10/1997 Rafalovich et al. ..... 165/236
5,819,551 A * 10/1998 Fukumoto et al. ..... 62/324.1
5,848,537 A * 12/1998 Biancardi et al. ..... 62/324.6
6,050,102 A * 4/2000 Jin ..... 62/324.6
6,094,930 A * 8/2000 Zeng et al. ..... 62/324.6
6,138,466 A * 10/2000 Lake et al. ..... 62/199
6,212,892 B1 * 4/2001 Rafalovich ..... 62/90
6,237,351 B1 * 5/2001 Itoh et al. ..... 62/196.3

* cited by examiner

*Primary Examiner*—William C. Doerrler
*Assistant Examiner*—Mark S. Shulman
(74) *Attorney, Agent, or Firm*—Birch, Stewart, Kolasch & Birch, LLP

(57) ABSTRACT

Heat pump and a method for controlling a cooling/heating capability thereof, in which a capacity varying device is improved for adjusting a cooling/heating capability, the heat pump including a compressor having an inlet for drawing, and compressing low temperature and low pressure refrigerant, and an outlet for discharging the compressed refrigerant, a four way valve for connecting the outlet and the inlet to an indoor heat exchanger and an outdoor heat exchanger selectively depending on cooling/heating, the indoor heat exchanger for evaporating/condensing the refrigerant by heat exchange with room air in cooling/heating respectively, the outdoor heat exchanger for evaporating/condensing the refrigerant by heat exchange with external air, a capillary tube having a reduced diameter for expansion of the refrigerant, a change over valve having a plunger movable by a pressure difference provided therein, and a connection tube connected the indoor heat exchanger and a four way valve, and a bypass tube connected between the connection tube and the change over valve.

9 Claims, 5 Drawing Sheets

HEAT PUMP AND METHOD FOR CONTROLLING OPERATION THEREOF

BACKGROUND OF THE INVENTION

1. Field of the Invention

The present invention relates to a heat pump, and more particularly, to a heat pump and a method for controlling a cooling/heating capability thereof, which can make an efficient control of a cooling/heating capability according to a cooling/heating condition of the heat pump.

2. Background of the Related Art

In general, the heat pump is an air conditioner in which heat absorption and dissipation of a refrigerant is used for cooling/heating a room, selectively. FIG. 1 illustrates a cooling operation of a related art heat pump, and FIG. 2 illustrates a heating operation of a related art heat pump schematically. The related art heat pump is provided with a compressor 1 for compressing the refrigerant, an indoor and an outdoor heat exchangers 4 and 3 installed inside of the room and outside of the room for condensing or evaporating the refrigerant, and capillary tube 5 between the heat exchangers. In general, according to an operation requirements, such as a room temperature and the like, in operation of the heat pump, a heating load required for a heating is greater by 1.4 times than a cooling load required for cooling. In order to adjust the cooling/heating capacity of the f heat pump, there are a change over valve 6 on the compressor 1, a flow cut-away valve 7 and a back pressure capillary tube 8 for controlling the change over valve 6.

A process for controlling a cooling capacity of the related art heat pump will be explained. The refrigerant compressed at the compressor 1 flows to the outdoor heat exchanger 3 through a four-way valve 2 and is condensed at the outdoor heat exchanger 3, expanded at the capillary tube 5, evaporated at the indoor heat exchanger 4, and flows to the compressor 1, again. On the same time with this, the flow cut-away valve 7 connected to an inlet to the compressor 1 is opened, a portion of the change-over valve on the compressor 1 connected to the flow cut-away valve 7 becomes to have a low pressure, while a portion of the change-over valve 6 in communication with the compressor 1 becomes to have a high pressure. Accordingly, a plunger (not shown) at an end of the change-over valve in communication with the compressor is pushed back by a pressure difference until the plunger is blocked by a stopper, to cause diffusion of the compressed refrigerant in the compressor 1 into an inlet 12, and the high pressure refrigerant flowing through the back pressure capillary tube 8 connected to an outlet 11 of the compressor 1 to flow to the inlet 12 through the flow cut-away valve 7. And, the refrigerant compressed at the compressor 1 flows to the indoor heat exchanger 4 following a flow path of the indoor heat exchanger 4 selected by the four way valve 2, is condensed at the indoor heat exchanger 4, expanded at the capillary tube 5, evaporated at the outdoor heat exchanger 3, and flows back to the compressor 1 again. During operation of the heat pump, the flow cut-away valve 7 is kept closed, to block flow of the high pressure refrigerant flowing to the back pressure capillary tube through the outlet 11 into the inlet 12 of the compressor 1. Accordingly, since a pressure of the refrigerant compressed at the compressor and passed through the back pressure capillary tube 8 is higher than a pressure of the refrigerant before being compressed in the compressor 1, the plunger 61 in the change-over valve 6 is drawn toward the compressor 1, to isolate the compressor 1 from the change-over valve 6. According to the foregoing process, a rate of refrigerant discharge from the compressor 1 is controlled for the cases of cooling/heating, and cooling/heating capability of the heat pump is varied.

However, the use of the flow cut away valve and the back pressure capillary tube in cooling, and the capillary tube in heating of the related art heat pump for varying the cooling/heating capability makes a system of the heat pump complicated, deteriorates a productivity, and pushes up a production cost. The leakage of the refrigerant through the back pressure capillary tube 8 during cooling drops the cooling capability, that reduces a system efficiency, unnecessarily.

SUMMARY OF THE INVENTION

Accordingly, the present invention is directed to a heat pump and a method for controlling operation thereof that substantially obviates one or more of the problems due to limitations and disadvantages of the related art.

An object of the present invention is to provide a heat pump and a method for controlling operation thereof, in which a discharge rate of the compressor is controlled for varying cooling/heating capability efficiently, to meet a required cooling/heating capability ratio.

Another object of the present invention is to provide a heat pump and a method for controlling operation thereof, in which a cooling/heating capability is varied efficiently, for improving a system efficiency.

Other object of the present invention is to provide a heat pump and a method for controlling operation thereof, which has a simple cooling/heating capability varying system for easy fabrication and reduction of a production cost. Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the heat pump includes a compressor having an inlet for drawing, and compressing low temperature and low pressure refrigerant, and an outlet for discharging the compressed refrigerant, a four way valve for connecting the outlet and the inlet to an indoor heat exchanger and an outdoor heat exchanger selectively depending on cooling/heating, the indoor heat exchanger for evaporating/condensing the refrigerant by heat exchange with room air in cooling/heating respectively, the outdoor heat exchanger for evaporating/condensing the refrigerant by heat exchange with external air, a capillary tube having a reduced diameter for expansion of the refrigerant, a change over valve having a plunger movable by a pressure difference provided therein, and a connection tube connected the indoor heat exchanger and a four way valve, and a bypass tube connected between the connection tube and the change over valve.

The heat pump of the present invention controls a discharge of the compressor by using a bypass tube to increase a ratio of cooling/heating which is approx. 1.4 for prevention of reduction of a system efficiency.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
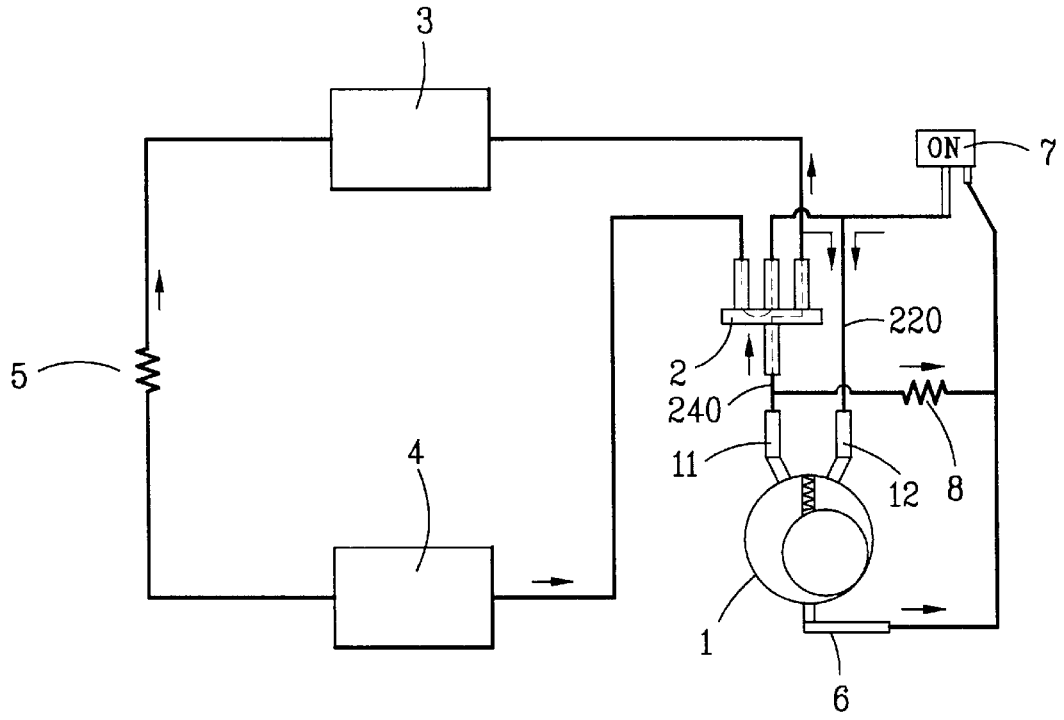
FIG. 1 illustrates a cooling operation of a related art heat pump, schematically.
Figure 2:
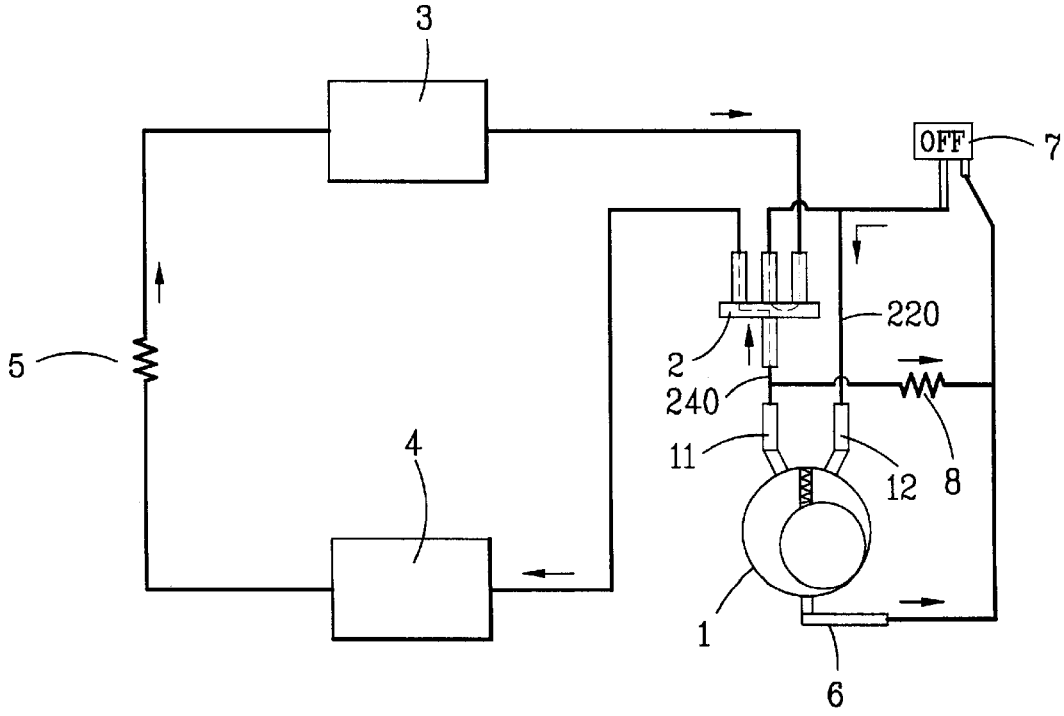
FIG. 2 illustrates a heating operation of a related art heat pump, schematically.
Figure 3:
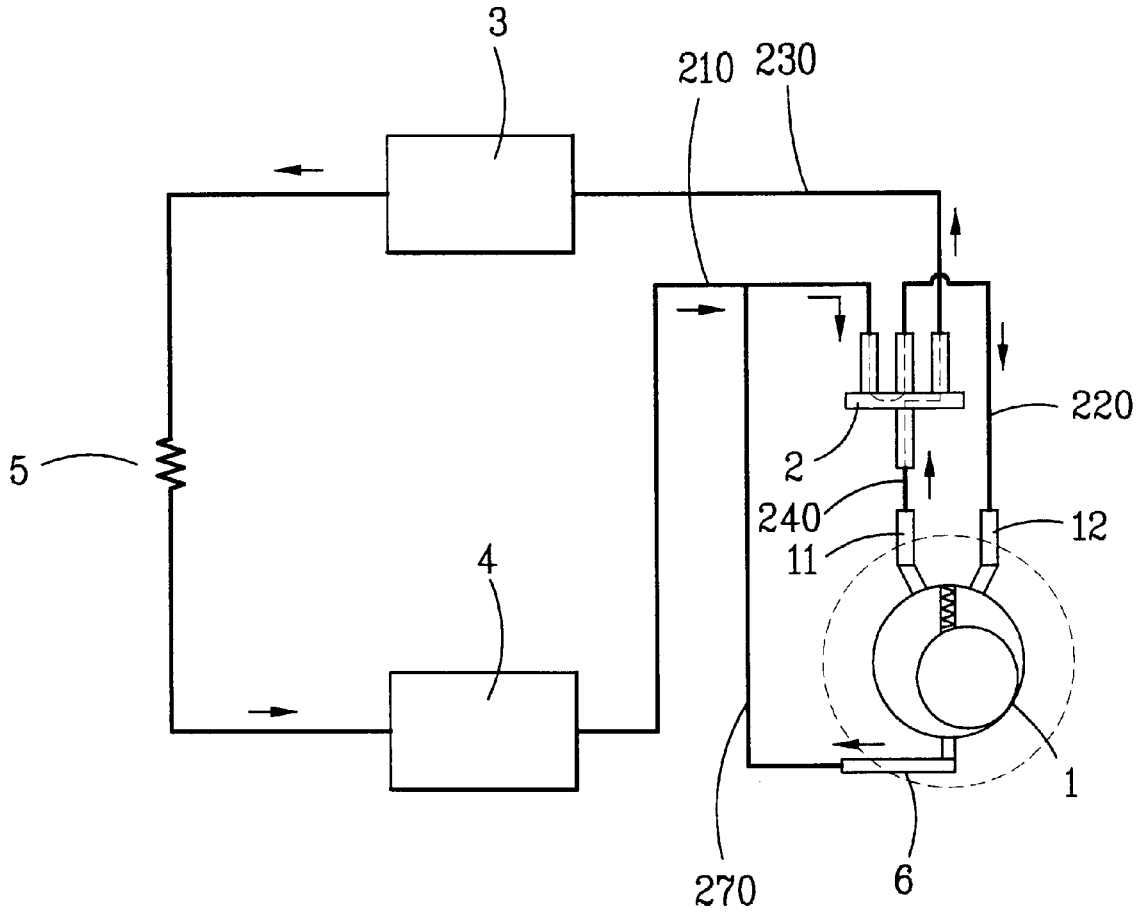
FIG. 3 illustrates a cooling operation of a heat pump in accordance with a preferred embodiment of the present invention, schematically.

Reference will now be made in detail to the preferred embodiments of the present invention, examples of which are illustrated in the accompanying drawings. In explaining embodiments of the present invention, identical components will be given the same name and reference symbols, and repeated explanations of which will be omitted. FIG. 3 illustrates a cooling operation of a heat pump in accordance with a preferred embodiment of the present invention schematically, referring to which a system and operation of the heat pump will be explained.

Referring to FIG. 3, the heat pump in accordance with a preferred embodiment of the present invention includes a compressor 1 having an outlet 11 for discharging compressed refrigerant, an inlet 12 for drawing the refrigerant from a heat exchanger, and one side connected to a change over valve to be in communication with a compression chamber thereof, and an outdoor heat exchanger 3 and an indoor heat exchanger 4 for cooling and heating room air by making heat change between refrigerant and coolant. And, the heat pump further includes a capillary tube 5 connected to the heat exchanger for throttling, and expanding the refrigerant to form a low pressure and low temperature refrigerant, and a four way valve 2 for changing refrigerant flow paths of the heat exchangers and the compressors 1 according to a mode of operation(cooling mode or heating mode).

The four way valve 2 has four ports; a left port is connected to the indoor heat exchanger 4 and a first connection tube 210, a center port is connected to the inlet 12 of the compressor 1 through a second connection tube 220, a right port is connected to the outdoor heat exchanger 3 through a third connection tube 230, and a lower port opposite to the above ports is connected to the outlet 11 of the compressor 1 through a fourth connection tube 240.

In cooling (FIG. 3), the right port is opened to open a refrigerant flow path between the outlet 11 and the outdoor heat exchanger, and the left port and the center port are opened to open a refrigerant flow path flowing to the compressor.

In heating (FIG. 5), the left port is opened to open a refrigerant flow path between the outlet 11 of the compressor and the indoor heat exchanger 4, and the center port and the right port are opened to open a refrigerant flow path between the outdoor heat exchanger 3 and the inlet 12 to the compressor.

There is a bypass tube 270 connected between the first connection tube 210, connecting the left port to the indoor heat exchanger 4, and a change over valve 6 for varying a discharge rate of the compressor.

Figure 4:
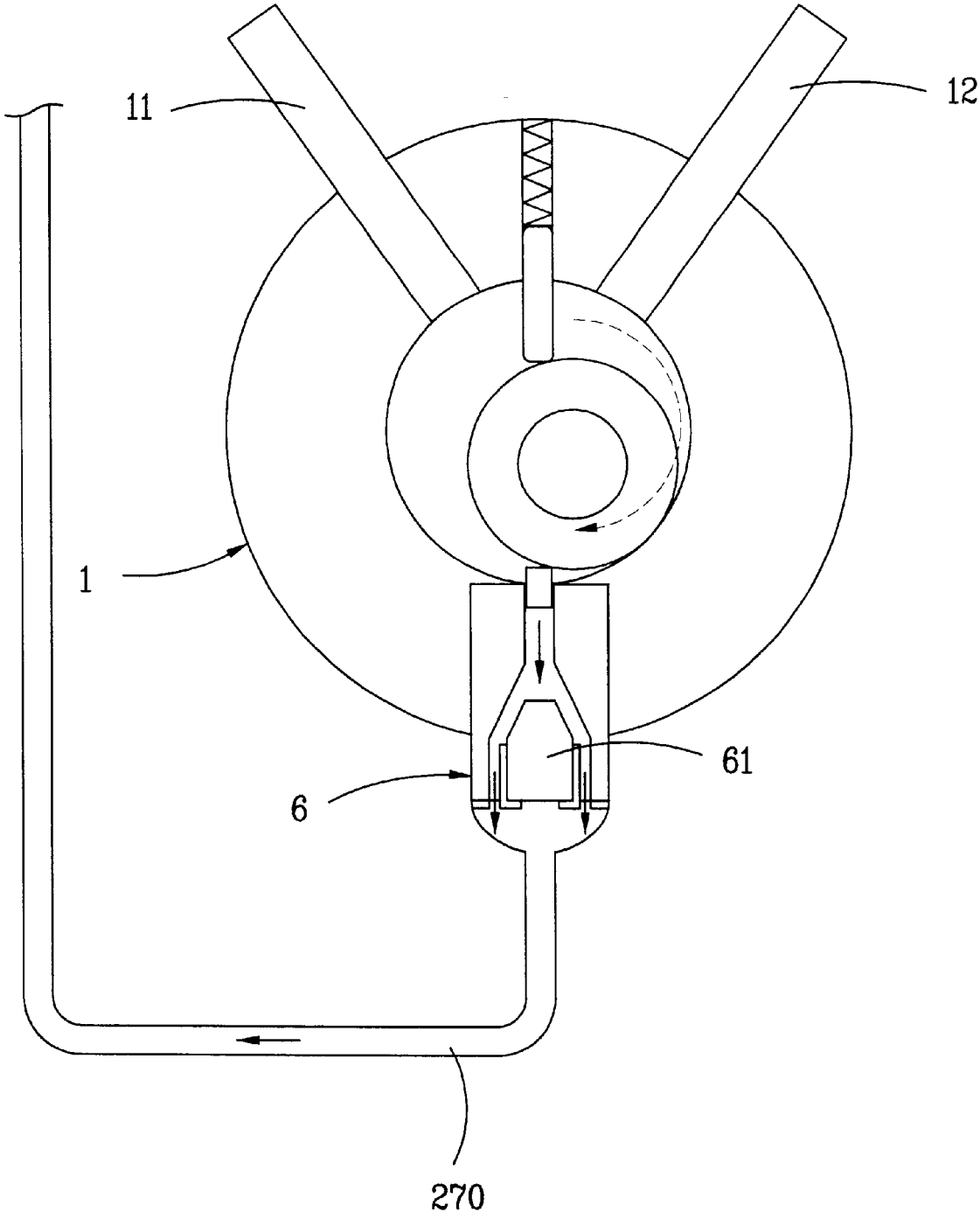
FIG. 4 illustrates an enlarged view of a key part of a heat pump for controlling a cooling capability in accordance with the present invention.

As illustrated in FIG. 4, the cylindrical change over valve 6, fitted to be in communication with an inside of the compressor 1, has a plunger 61 therein movable by a pressure difference until blocked by a stopper provided in rear thereof. The stopper forms a flow passage around an outer circumference of the plunger, to set up a refrigerant flow path from the refrigerant flow path around the plunger to the inlet 12 of the compressor through the bypass tube 270 and the first connection tube 210.

Upon putting the aforementioned heat pump of the present invention into operation, the refrigerant compressed at the compressor 1 flows through the outlet 11, through the fourth connection tube 240 and a right port of the four way valve 2. Therefrom, the refrigerant flows into the outdoor heat exchanger 3. The high temperature and high pressure refrigerant flowed into the outdoor heat exchanger 3 is condensed as the refrigerant makes heat exchange with a coolant, such as an external air or water. Then, the refrigerant passes through the capillary tube 5 and is expanded to form a low temperature and low pressure refrigerant of two phases. The refrigerant is evaporated as it passes through the indoor heat exchanger 4 and makes heat exchange with high temperature room air. The refrigerant enters into the inlet 12 through the second connection tube 220 via the left port and the center port. The refrigerant is then compressed into a high temperature and high pressure refrigerant at the compressor 1 again, to repeat the foregoing cycle, to cool down the room air.

Referring to FIG. 4, the change over valve 6 will be explained in more detail.

A portion of low pressure refrigerant flowing to the inlet 12 from the indoor heat exchanger 4 flows into the bypass tube 270, connecting the first connection tube 210 and the change over valve 6. According to this, the plunger 61 in the change over valve 6 is drawn to the bypass tube 270 by a pressure difference between the low pressure refrigerant and the high pressure refrigerant in the compressor 1. This opens a hole connecting the compressor 1 and the change over valve 6, to cause a portion of compressed refrigerant in the compressor 1 to flow to the inlet of the compressor through the bypass tube 270. This reduces an amount of refrigerant compressed at the compressor 1, to provide a compression capability lower than an original compression capability of the compressor 1. That is, as a portion of low pressure refrigerant flowing in the first connection tube 210 flows into one side of the change over valve 6 through the bypass tube 270, to cause the plunger 61 in the change over valve 6 to be drawn toward the bypass tube 270 by the pressure difference, which permits the refrigerant in the compressor 1 flowing out of the compressor 1 through the bypass tube 270 to re-enter into the compressor 1.

Figure 5:
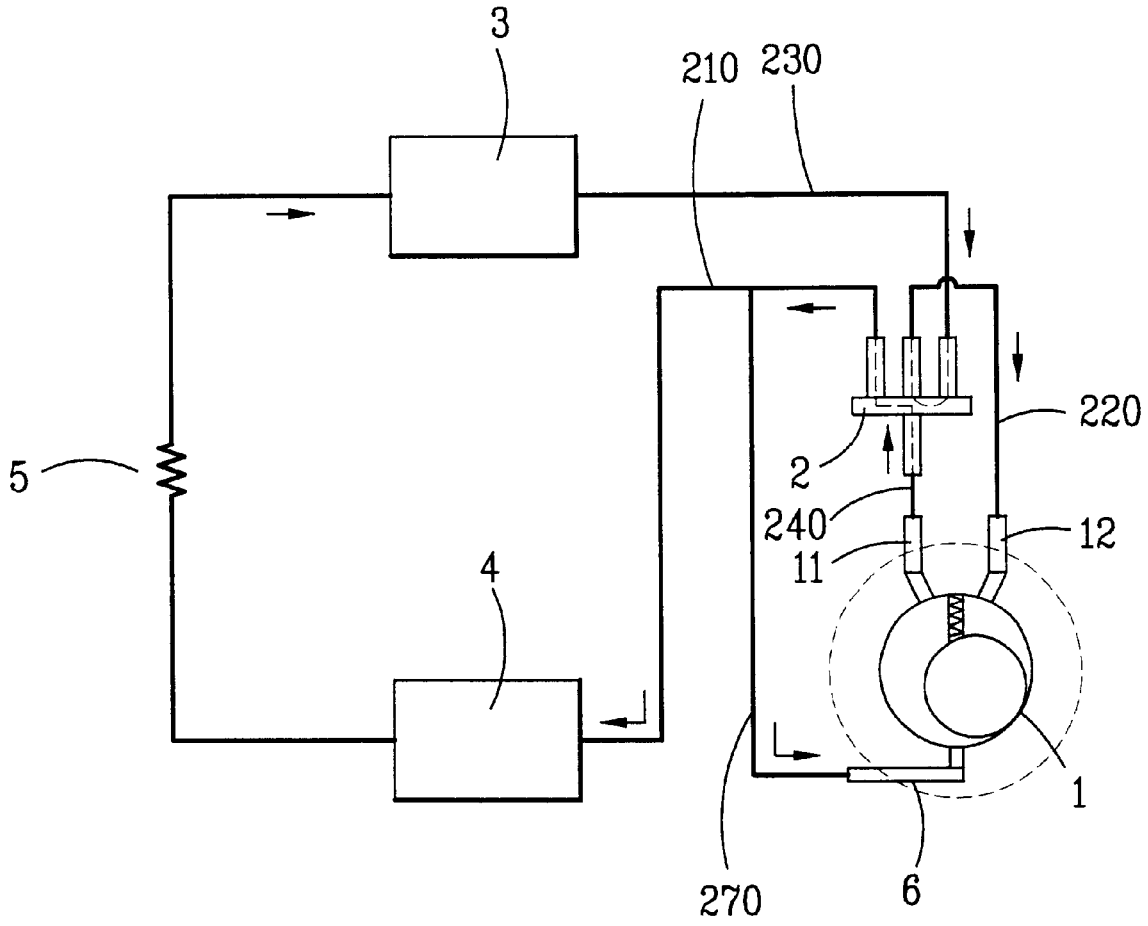
FIG. 5 illustrates heating operation of a heat pump of the present invention, schematically; and, FIG. 6 illustrates an enlarged view of a key part of a heat pump for controlling a heating capability in accordance with the present invention.
Figure 6:
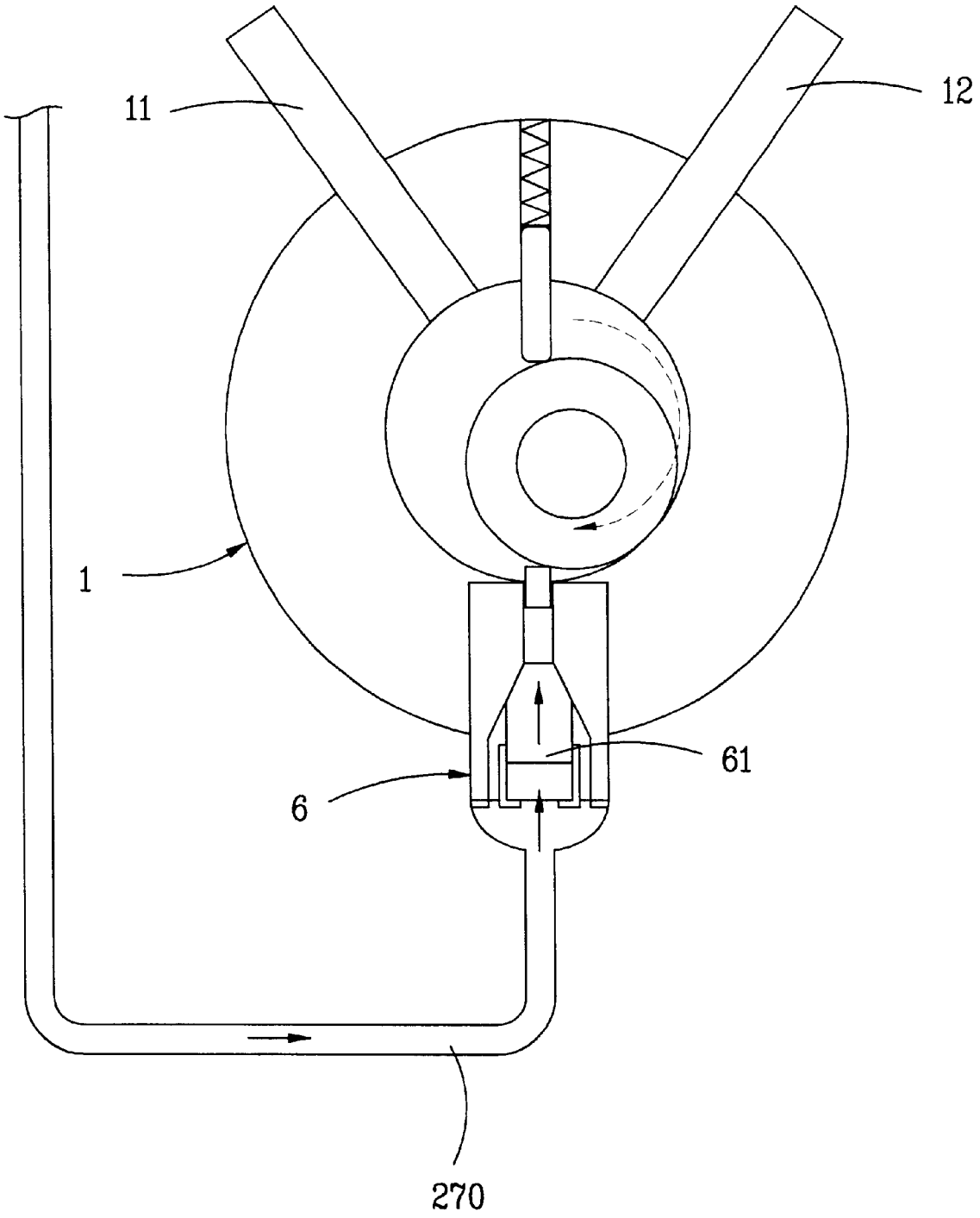

The heating operation is illustrated in FIGS. 5 and 6. Upon opening the left port, in the four way valve, the refrigerant compressed in the compressor 1 flows to the indoor heat exchanger 4 connected to the first connection tube 210 through the outlet 11 and the fourth connection tube 240. The refrigerant makes heat exchange with a low temperature air drawn from the room, and is condensed, to warm the room air. The condensed refrigerant is turned into a low temperature and low pressure refrigerant as the refrigerant passes through the capillary tube 5, evaporated at a low temperature through the heat exchanger 3, and flows to the inlet 12 of the compressor 1. In this instance, a portion of the high temperature and high pressure refrigerant provided through the first connection tube 210 pressurizes one side of the change over valve 6 through the bypass tube 270. The high pressure refrigerant pushes the plunger in the change over valve 6 toward the compressor 1 because the pressure of the high temperature and high pressure refrigerant provided through the first connection tube 210 is higher than the pressure formed in front of the plunger 61 transmitted from the compressor 1.

According to the above arrangement, the hole communicating between the compressor 1 and the change over valve 6 is blocked, to repeat the heating cycle without leakage of the compressed refrigerant from the compressor 1. That is, by causing a portion of the high pressure refrigerant to flow into one side of the change over valve 6 through the bypass tube 270, which causes the plunger 61 to be drawn toward the compressor side by a pressure difference to block the hole communicating between the change over valve 6 and the compressor 1, leakage of refrigerant from the compressor is prevented.

As has been explained, the heat pump of the present invention controls a cooling/heating capability by using only one bypass tube. Therefore, fabrication of the heat pump is made more simple and a production cost of the heat pump can be lowered, as many components in the related art can be eliminated. And, since there is no leakage of refrigerant during cooling and heating except through the bypass tube, a system efficiency of the heat pump can be improved. By making a heating capability 1.4 times of a cooling capability by using the bypass tube, which reduces unnecessary operation of the compressor, an entire efficiency of the heat pump can be improved.

It will be apparent to those skilled in the art that various modifications and variations can be made in the heat pump and a method for controlling operation thereof of the present invention without departing from the spirit or scope of the invention. Thus, it is intended that the present invention cover the modifications and variations of this invention provided they come within the scope of the appended claims and their equivalents.

What is claimed is:

1. A heat pump comprising:

a compressor having an inlet for drawing, and compressing low temperature and low pressure refrigerant, and an outlet for discharging the compressed refrigerant;

a four way valve for connecting the outlet and the inlet to an indoor heat exchanger and an outdoor heat exchanger selectively depending on cooling/heating;

the indoor heat exchanger for evaporating/condensing the refrigerant by heat exchange with room air in cooling/heating, respectively;

the outdoor heat exchanger for evaporating/condensing the refrigerant by heat exchange with external air;

a capillary tube having a reduced diameter for expansion of the refrigerant connecting the indoor hear exchanger to the outdoor heat exchanger;

a change over valve having a plunger movable by a pressure difference provided therein, the change over valve being in communication with the compressor; and, a connection tube connecting the indoor heat exchanger and the four way valve, and a bypass tube connected between the connection tube and the change over valve.

2. A heat pump as claimed in claim 1, wherein the change over valve includes a through hole having a first end with a small inside diameter and a second end with an expanded inside diameter into which the plunger is inserted.

3. A heat pump as claimed in claim 2, wherein the plunger includes a tapered portion facing to the first end of the change over valve.

4. A heat pump as claimed in claim 2, wherein the second end of the change over valve is connected to the bypass tube, and the first end of the change over valve is in communication with the compressor.

5. A heat pump as claimed in claim 2, wherein the first end of the change over valve communicates with an inside of the compressor.

6. A method for controlling a cooling capability of a heat pump during a cooling mode, comprising the steps of:

taking a portion of a low pressure refrigerant flowing to a compressor;

leading the portion to one side of a change over valve via a bypass tube, to cause a plunger of the change over valve to be drawn toward the bypass tube due to a pressure difference between a high pressure refrigerant in the compressor and the low pressure refrigerant, so that refrigerant flows from the compressor to the bypass tube; and, leading the refrigerant, which flowed from the compressor to the bypass tube, to the compressor again, through an inlet of the compressor.

7. A method as claimed in claim 6, wherein the plunger includes a stopper at a first end of the change over valve, for selectively allowing or preventing communication between a compression chamber of the compressor and the bypass tube.

8. A method for controlling a heating capability of a heat pump during a heating mode, comprising the steps of:

taking a portion of high pressure refrigerant discharged from a compressor; and, leading the portion to one side of a change over valve via a bypass tube, to cause a plunger of the change over valve to be drawn toward the compressor due to a pressure difference between the refrigerant in the bypass tube and the refrigerant in the compressor, so that the change over valve isolates the compressor from the bypass tube.

9. A method as claimed in claim 8, wherein the plunger is drawn toward a communication hole of the change over valve which communicates with a compression chamber of the compressor to shut the communication hole.

* * * * *